US006050013A

United States Patent [19]

Heaton et al.

[11] Patent Number: 6,050,013

[45] Date of Patent: Apr. 18, 2000

[54] MOUNTING DEVICE FOR EXIT SIGN COVERS

[75] Inventors: Thomas K. Heaton, Thomaston; David Evarts, Fairfield, both of Conn.

[73] Assignee: Dual-Lite Inc., Cheshire, Conn.

[21] Appl. No.: 09/124,566

[22] Filed: Jul. 29, 1998

[51] Int. Cl.[7] ..... G09F 13/04

[52] U.S. Cl. ..... 40/570; 40/574

[58] Field of Search ..... 40/570, 574; 292/80, 292/81, 83, 87

[56] References Cited

U.S. PATENT DOCUMENTS

| | | | |
|---|---|---|---|
| 2,029,221 | 1/1936 | Burgess et al. | 40/574 |
| 2,305,432 | 12/1942 | Kupfermann et al. | 292/87 |
| 3,291,975 | 12/1966 | McCullough et al. | 40/574 X |
| 3,536,348 | 10/1970 | Tedesco | 292/87 X |
| 5,444,931 | 8/1995 | Hillstrom | 40/574 X |

*Primary Examiner*—Joanne Silbermann
*Attorney, Agent, or Firm*—Ware, Fressola, Van der Sluys & Adolphson LLP

[57] ABSTRACT

In an exit sign, a cover member for an emergency exit sign has a pair of hook members on its bottom wall and a pair of resilient spring finger members on its top wall. The hook members are dimensionally sized and appropriately positioned to engage catch members on an exit sign housing while the spring finger members resiliently snap fit within spaced apart apertures in the top wall of the exit sign housing thereby retaining the cover member in its closed position. A pair of flexible straps secure the cover member to the exit sign housing to keep them in assembly when the cover member is in its open position.

27 Claims, 3 Drawing Sheets

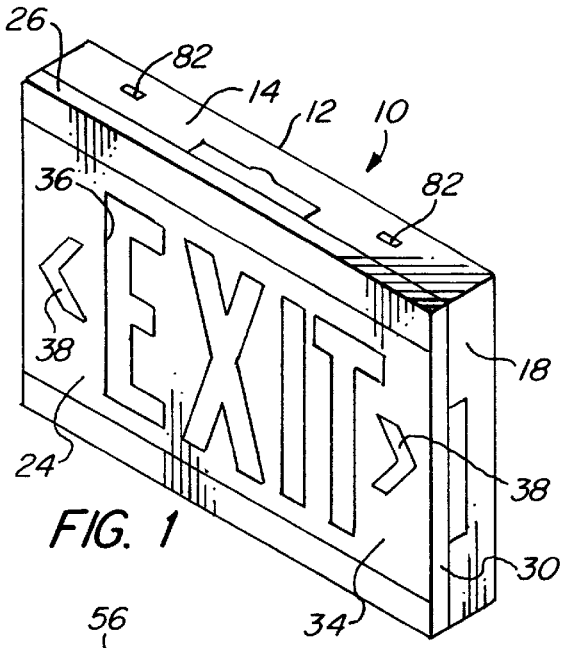
FIG. 1
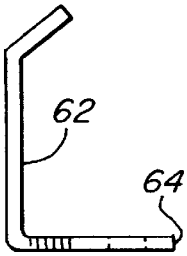
FIG. 5
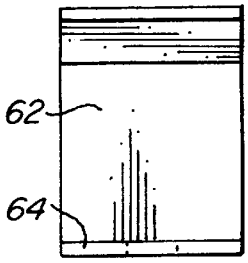
FIG. 6
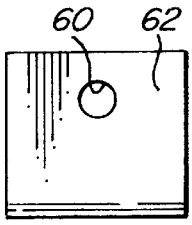
FIG. 7
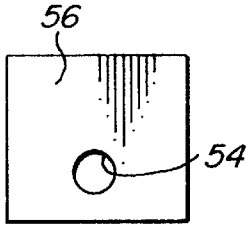
FIG. 3
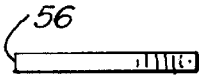
FIG. 4
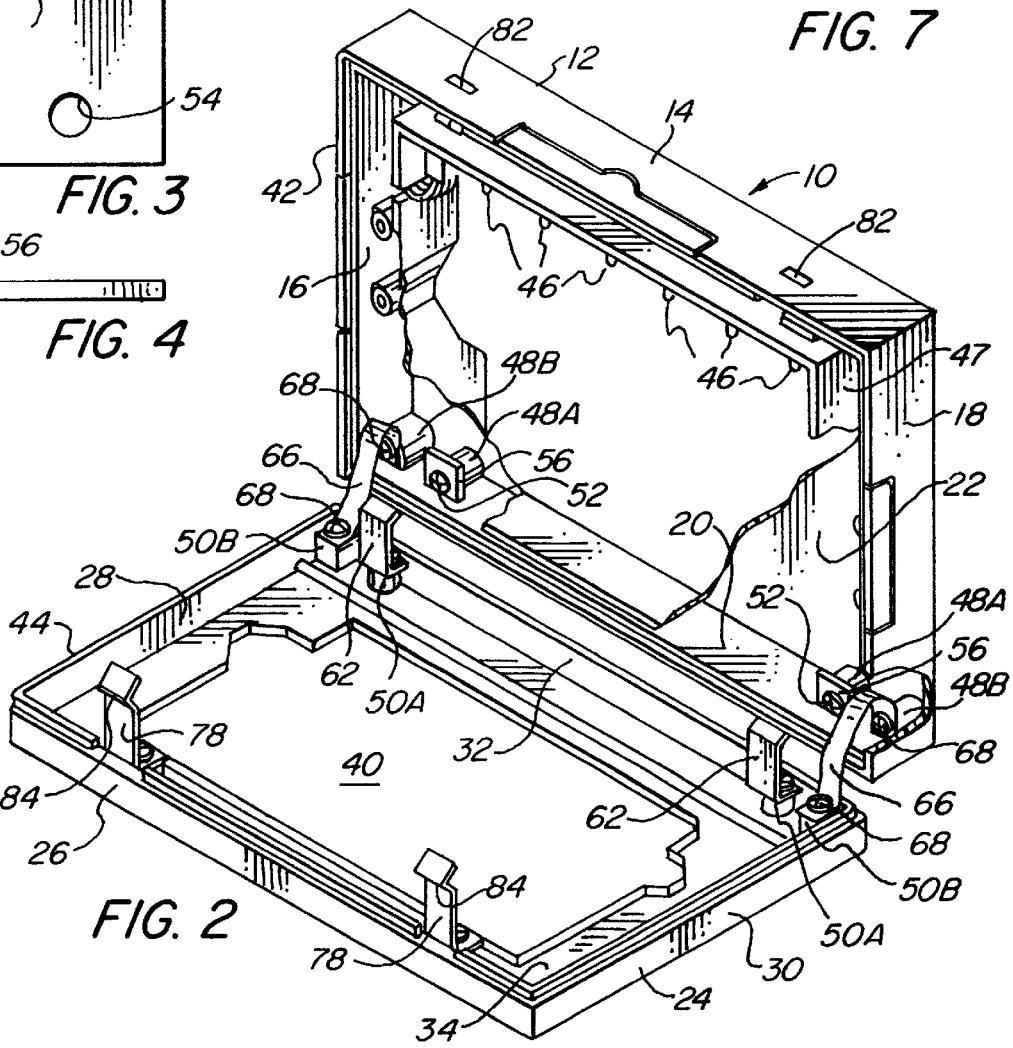

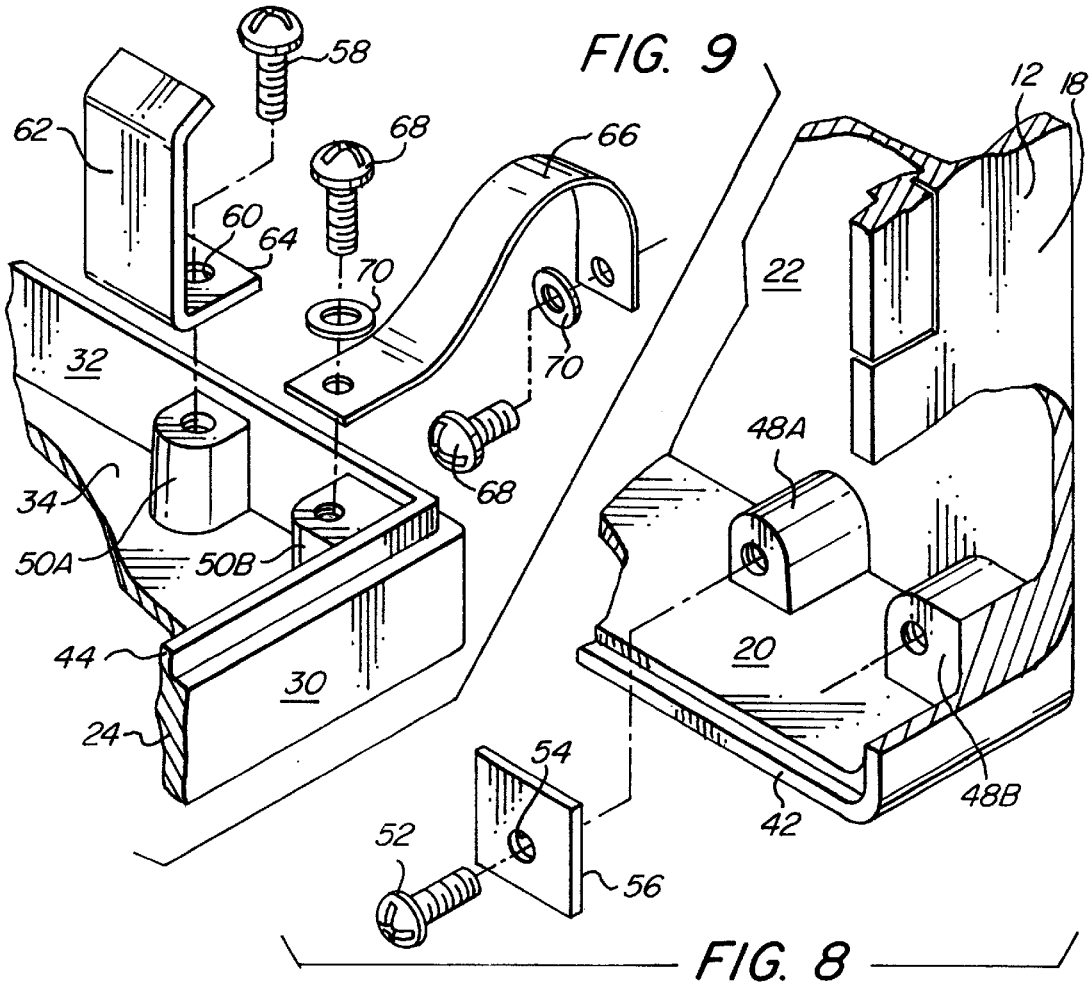
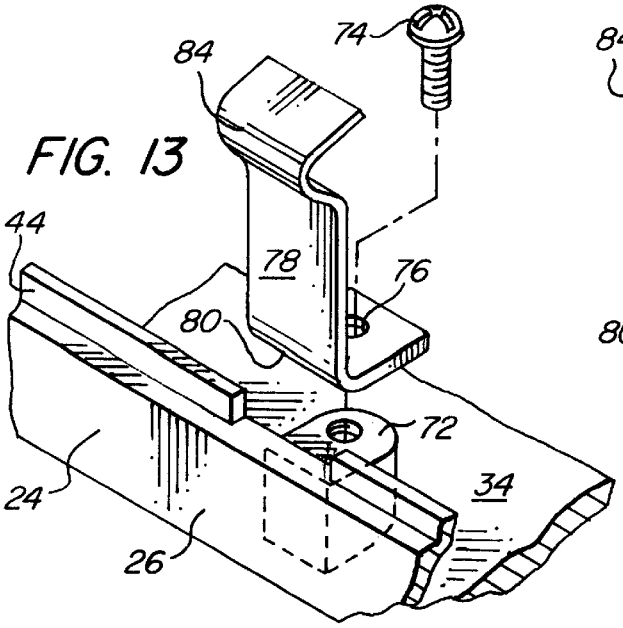
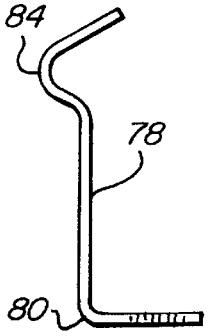
FIG. 10
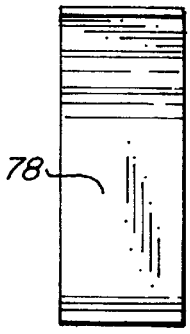
FIG. 11
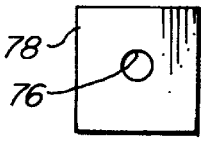
FIG. 12

MOUNTING DEVICE FOR EXIT SIGN COVERS

BACKGROUND OF THE INVENTION

1. Technical Field

The present invention relates generally to emergency exit signs and, more particularly, to mounting covers on emergency exit signs.

2. Description of the Background Art

Under current local fire and building codes, buildings to which the public has access are required to have signage therein identifying the exits. Most of these exit signs are required to exhibit a specific amount of illumination and, oftentimes, must have an emergency backup power source to provide emergency illumination for a specified period of time during periods when utility power to the building is discontinued, thereby facilitating egress of persons from the building.

Traditionally, exit signs have housings formed from sheet metal, plastic and/or cast aluminum on which are mounted one or more covers having an exit stencil thereon. These components cooperate to form an enclosure for the necessary electrical lighting components such as low voltage lamps as well as appropriate wiring, transformers and auxiliary power supplies. The covers should be easily mountable but provide tamper-resistance for the exit signs.

SUMMARY OF THE INVENTION

It is an object of the present invention to provide a novel exit sign mounting for its cover which allows hooking of the cover to the housing.

It is also an object to provide such a mounting having a snap interconnection allowing expedited fastening of the cover.

Still another object is to provide such a mounting which makes the exit sign is tamper resistant.

A further object is to provide such a mounting which may be readily and economically fabricated and will enjoy a long life in operation.

It has now been found that the foregoing and related objects can be readily attained in an exit sign having a cover member which has a pair of hook members on its bottom wall and a pair of resilient spring finger members on its top wall. The hook members are dimensionally sized and appropriately positioned to engage catch members on an exit sign housing while the resilient finger members resiliently snap fit within spaced apart apertures in the top wall of the exit sign housing thereby retaining the cover member in its closed position. A pair of flexible straps secure the cover member to the exit sign housing to keep them in assembly when the cover member is in its open position.

The invention will be fully understood when reference is made to the following detailed description taken in conjunction with the accompanying drawings.

BRIEF DESCRIPTION OF THE DRAWINGS

FIG. 1 is a perspective view of an exit sign embodying the present invention;

FIG. 2 is a perspective view of the exit sign with its cover member in its open position to illustrate internal structure;

FIGS. 3 and 4 are side and bottom views respectively of the catch member;

FIGS. 5, 6 and 7 are side, rear and bottom views respectively of the hook member;

FIG. 8 is a partial perspective exploded view of the exit sign housing with a portion broken away showing installation of the catch member of FIGS. 3 and 4;

FIG. 9 is a partial perspective exploded view of the cover member showing installation of the hook member of FIGS. 5, 6 and 7 and the flexible plastic strap;

FIGS. 10, 11 and 12 are side, rear and bottom views respectively of the resilient finger member;

FIG. 13 is a partial perspective exploded view of the cover member showing installation of the resilient finger member of FIGS. 10, 11 and 12.

DETAILED DESCRIPTION OF THE PREFERRED EMBODIMENT

Figure 14:
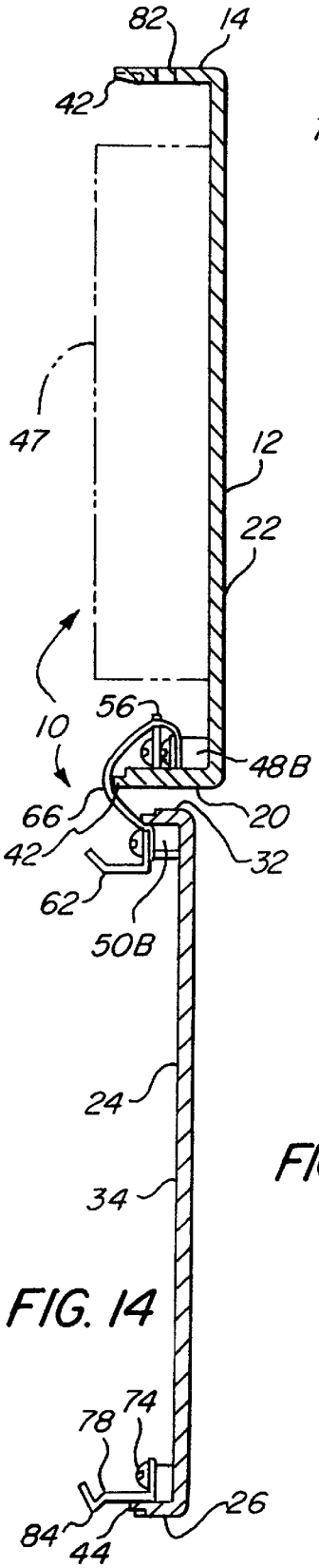
FIGS. 14 through 17 are cross-sectional views of the exit sign of the present invention showing installation of the cover member from its open position to its closed position on the exit sign housing.

Referring first to FIG. 1 of the drawings, therein illustrated is the exit sign construction of this invention generally designated by the numeral 10. The exit sign 10 has an exit sign housing generally indicated by the numeral 12 mountable to both a canopy bracket (not shown) which is in turn mountable to a standard electrical junction box (not shown) in a manner explained in a copending U.S. Ser. No. 09/124,570 filed Jul. 29, 1998. With this arrangement, the exit sign construction of this invention can be mounted directly to a standard electrical junction box found in a ceiling or wall of a building in any desired location.

As seen in FIG. 2, the exit sign housing 12 is a rectangularly shaped aluminum-cast frame formed by top wall 14, side walls 16, 18, bottom wall 20 and rear wall 22. Detachably mounted to an open side of the exit sign housing 12 is an aluminum-cast cover member 24 formed by a top wall 26, side walls 28, 30, bottom wall 32 and front wall 34. The front wall 34 incorporates a large stencil 36 having the letters "EXIT" and removable arrows 38 in the major surface thereof and a colored plastic diffuser 40 therebehind. Depending on the type of installation and the needs of the user, the rear wall 22 could also have an "EXIT" stencil and a colored plastic diffuser in a manner similar to the cover member 24 as would be apparent to those skilled in the art. The exit sign housing 12 and the cover member 24 are dimensionally sized to fit together by means of cooperating extending lips 42 and 44 thereon in a manner to be explained further hereinafter thereby cooperating to form an enclosure for the necessary electrical lighting components such as low voltage light emitting diodes 46 located in an internal plastic container 47 as well as appropriate wiring, transformer and auxiliary power supply (all not shown).

Referring now to FIGS. 3 through 9 taken in conjunction with FIG. 2, the exit sign housing 12 has a plurality of threaded bosses 48A, 48B extending from its rear wall 22 along its bottom wall 20 while the cover member 24 has an equal number of threaded bosses 50A, 50B extending from its front wall 34 along its bottom wall 32. The threaded bosses 48A receive screws 52 which extend through an aperture 54 defined in each steel catch member of mating positioner 56 to secure the catch members 56 to the exit sign housing 12. Similarly, the threaded bosses 50A receive screws 58 which extend through an aperture 60 defined in each steel hook member on hook-like positioner 62 to secure the hook members 62 to the cover member 24. An edge surface 64 of each hook member 62 indexes against the bottom wall 32 to properly align the hook members 62. To keep the cover member 24 secured to the exit sign housing 12, a pair of flexible plastic straps 66 are secured between the threaded bosses 48B and 50B by screws 68 and washers 70.

With reference to FIGS. 10 through 13 taken in conjunction with FIG. 2, the cover member 24 has threaded bosses 72 extending from its front wall 34 along its top wall 26. The threaded bosses 72 receive screws 74 which extend through an aperture 76 defined in each resilient steel hook-like finger member 78 to secure the resilient finger members 78 in a cantilevered manner to the cover member 24. A curved corner surface 80 of each resilient finger member 78 indexes against the top wall 26 to properly align the resilient finger members 78. It should be noted here that the top wall 14 of the exit sign housing 12 has a pair of spaced apart apertures 82 (FIGS. 1 and 2) dimensionally sized and appropriately positioned to receive curved engagement portions 84 (FIGS. 2, 10, 11 and 12) of the resilient finger members 78 when the cover member 24 is positioned on the exit sign housing 12 in its closed position.

Figure 15:
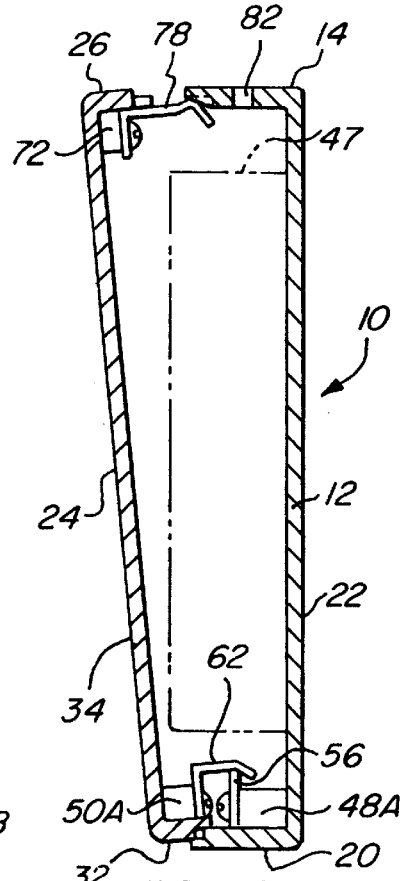
Figure 16:
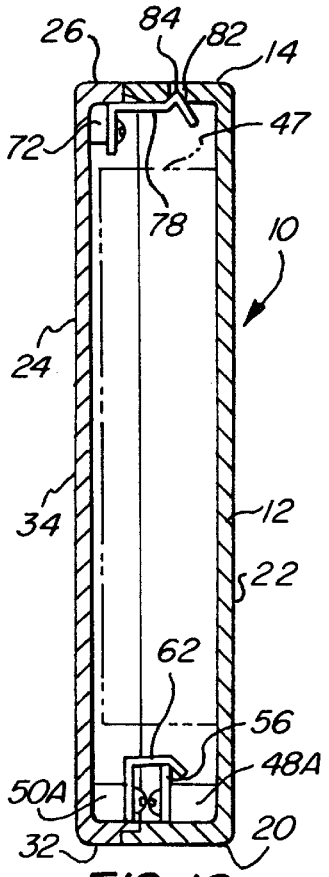
Figure 17:
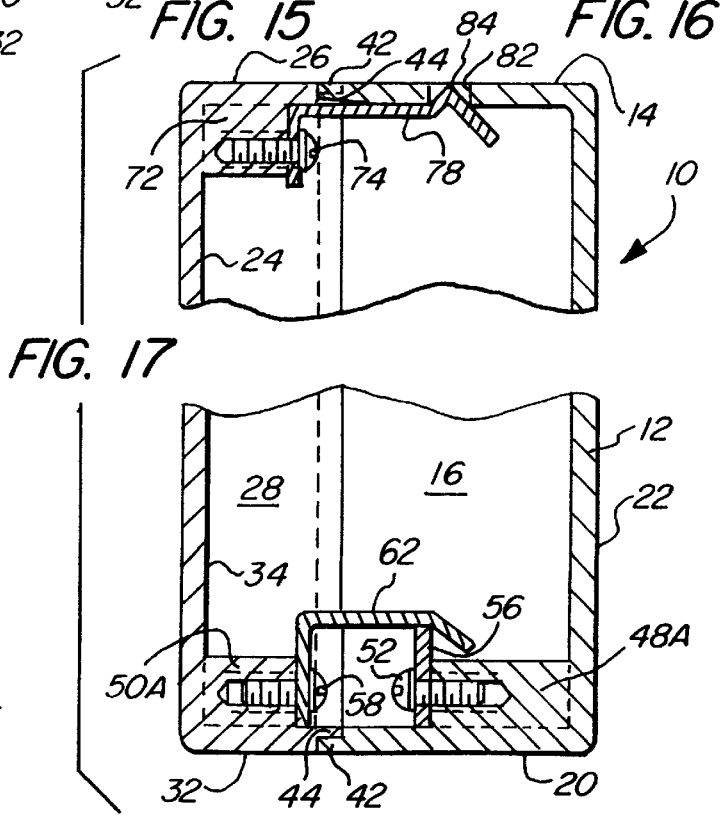

Turning now to FIGS. 14 through 17, the procedure for installation of the cover member 24 on the exit sign housing 12 can be understood therefrom. The cover member 24 in its open position shown in FIG. 14 is suspended by the resilient plastic straps 66 whereby the user can easily service the exit sign 10 as needed. To install the cover member 24 to its closed position on the exit sign housing 12, the user simply rotates the cover member 24 upward and positions the hook members 62 over the catch members 56 as shown in FIG. 15. Continued rotation of the cover member 24 relative to the exit sign housing 12 causes the resilient finger members 78 to deflect as they engage the top wall 14 of the exit sign housing 12. When the cover member 24 reaches its closed position as seen in FIGS. 16 and 17, the curved engagement portions 84 of the resilient finger members 78 resiliently snap fit within the spaced apart apertures 82 in the top wall 14 of the exit sign housing 12 thereby retaining the cover member 24 in its closed position. It should be noted from FIG. 17 that, in the closed position, the lips 42, 44 of the exit sign housing 12 and the cover member 24 tightly interfit. To reverse the snap-fitting arrangement of the first resilient finger members 78 and the spaced apart apertures 82, the user would insert a screw driver (not shown) into each of the spaced apart apertures 82 from the exterior of the exit sign housing 12 until the curved engagement portions 84 of each finger member disengages from its aperture 82. The cover member 24 could then be rotated to its open position (FIG. 14).

It should be appreciated by those skilled in the art that the resilient finger members 78 provide sufficient retaining force whereby it is difficult for a vandal to remove the cover member 24 by merely pulling on it without following the above mentioned opening procedures. Additionally, the tight interfit of the lips 42, 44 increases the difficulty by providing little pulling leverage for a vandal. Finally, the position of the apertures 82 in the top wall 14 of the housing, which would not normally be visible from ground level when the exit sign 10 is installed in its normal operating position on a wall or a ceiling, also makes it difficult for a vandal to discover the necessary opening procedures.

It will therefore be seen from the above that the present invention provides an effective means for facilitating installation of a cover member on an exit sign housing.

It will thus be seen that the objects set forth above, among those made apparent from the preceding description, are efficiently attained and, since certain changes may be made in the above product without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the invention which, as a matter of language, might be said to fall therebetween.

What is claimed is:

1. An exit sign comprising:

(a) a generally rectangularly shaped housing containing lighting components and having an open side for receiving a cover member;

(b) a cover member dimensionally sized to be received on said open side of said housing; and (c) means releasably retaining said cover member on said open side of said housing, said releasably retaining means comprising:

(i) a positioner on said cover member and a mating positioner on said housing, said positioner and mating positioner relatively position said cover member on said open side of said housing, and (ii) at least one resilient finger member on one of said cover member and said housing and at least one mating aperture on the other of said cover member and said housing, said at least one resilient finger member mates with said at least one mating aperture to releasably retain said cover member on said open side of said housing.

2. An exit sign in accordance with claim 1, wherein each said resilient finger member has an aperture engaging surface which is resiliently biased into an associated one of said at least one mating aperture.

3. An exit sign in accordance with claim 1, wherein each said resilient finger member has a hook-like profile.

4. An exit sign in accordance with claim 1, wherein each said resilient finger member is cantilevered from said cover member and mates with an associated one of said at least one apertures on said housing.

5. An exit sign in accordance with claim 4, wherein each said resilient finger member has a free end dimensionally sized and placed so as to engage said housing and bias said resilient finger member as said cover member is moved from an open position spaced from said open side of said housing to a closed position on said open side of said housing.

6. An exit sign in accordance with claim 5, wherein said at least one resilient finger member is disengaged from said at least one aperture in the open position and said at least one resilient finger member is matingly engaged in said at least one aperture in the closed position.

7. An exit sign in accordance with claim 1, wherein said at least resilient finger member is formed from a steel material.

8. An exit sign in accordance with claim 1, wherein said at least one mating aperture opens to an exterior of the exit sign thereby permitting engagement by a user of said at least one resilient finger from the exterior of the exit sign to release said at least one resilient finger from said at least one mating aperture.

9. An exit sign in accordance with claim 1, wherein said at least one resilient finger member is located adjacent a top wall of said cover member and said at least one mating aperture is defined in a top wall of said housing.

10. An exit sign in accordance with claim 9, wherein said positioner is on a bottom wall of said cover member and said mating positioner is on a bottom wall of said housing.

11. An exit sign in accordance with claim 1, wherein one of said positioner and said mating positioner is at least one hook-like member, the other is at least one catch for retaining said at least one hook-like member to relatively position said cover member on said open side of said housing.

12. An exit sign in accordance with claim 11, wherein said positioner is on said cover member and is said at least one hook-like member which engages said mating positioner which is on said housing, said mating positioner is said at least one catch for retaining said at least one hook-like member to relatively position said cover member on said open side of said housing.

13. An exit sign in accordance with claim 1, further including at least one strap interconnecting said housing and said cover member.

14. An exit sign in accordance with claim 13, wherein said at least one strap suspends said cover member from said housing when said cover is in an open position with said at least one resilient finger member disengaged from said at least one mating aperture.

15. An exit sign in accordance with claim 1, wherein one of said housing and cover member has at least one threaded boss and each said at least one resilient finger member is attached to an associated one of said at least one threaded boss by means of a screw.

16. An exit sign in accordance with claim 1, wherein said cover member has at least one threaded boss and said positioner is attached to said at least one threaded boss by means of a screw.

17. An exit sign in accordance with claim 16, wherein said housing member has at least one threaded boss and said mating positioner is attached to said at least one threaded boss by means of a screw.

18. An exit sign in accordance with claim 1, wherein said housing member has at least one threaded boss and said mating positioner is attached to said at least one threaded boss by means of a screw.

19. An exit sign comprising:

(a) a generally rectangularly shaped housing containing lighting components and having an open side for receiving a cover member;

(b) a cover member dimensionally sized to be received on said open side of said housing, said cover member has at least one threaded boss; and (c) means releasably retaining said cover member on said open side of said housing, said releasably retaining means comprising:

(i) a hook-like positioner on said cover member and a mating positioner releasably retained on said housing to create a catch for said hook-like positioner, said hook-like positioner engages said mating positioner to relatively position said cover member on said open side of said housing, said hook-like positioner is attached to said at least one threaded boss by means of a screw, and (ii) at least one member on one of said cover member and said housing and at least one mating element on the other of said cover member and said housing, said at least one member mates with said at least one mating element to releasably retain said cover member on said open side of said housing.

20. An exit sign in accordance with claim 19, wherein said hook-like positioner is on a bottom wall of said cover member and said mating positioner is on a bottom wall of said housing.

21. An exit sign in accordance with claim 19, further including at least one strap interconnecting said housing and said cover member.

22. An exit sign in accordance with claim 21, wherein said at least one strap suspends said cover member from said housing when said cover is in an open position with said at least one member disengaged from said at least one mating element.

23. An exit sign in accordance with claim 19, wherein said housing member has at least one threaded boss and said mating positioner is attached to said at least one threaded boss by means of a screw.

24. An exit sign comprising:

(a) a generally rectangularly shaped housing containing lighting components and having an open side for receiving a cover member, said housing member has at least one threaded boss;

(b) a cover member dimensionally sized to be received on said open side of said housing; and (c) means releasably retaining said cover member on said open side of said housing, said releasably retaining means comprising:

(i) a hook-like positioner on said cover member and a mating positioner releasably retained on said housing to create a catch for said hook-like positioner, said hook-like positioner engages said mating positioner to relatively position said cover member on said open side of said housing, said mating positioner is attached to said at least one threaded boss by means of a screw, and (ii) at least one member on one of said cover member and said housing and at least one mating element on the other of said cover member and said housing, said at least one member mates with said at least one mating element to releasably retain said cover member on said open side of said housing.

25. An exit sign in accordance with claim 24, wherein said hook-like positioner is on a bottom wall of said cover member and said mating positioner is on a bottom wall of said housing.

26. An exit sign in accordance with claim 24, further including at least one strap interconnecting said housing and said cover member.

27. An exit sign in accordance with claim 26, wherein said at least one strap suspends said cover member from said housing when said cover is in an open position with said at least one member disengaged from said at least one mating element.

* * * * *

UNITED STATES PATENT AND TRADEMARK OFFICE

CERTIFICATE OF CORRECTION

PATENT NO. : 6,050,013
DATED : April 18, 2000
INVENTOR(S) : Thomas K. Heaton and David Evarts It is certified that error appears in the above-identified patent and that said Letters Patent is hereby corrected as shown below:

On the cover page of the patent, under "References Cited", please add the following:

-- DUAL-LITE EMERGENCY LIGHTING PRODUCTS, 60-762 D16, 11/97.

Four (4) photographs of Emergi-Lite Preceptor Series Diecast Aluminum Exit Sign.

Emergi-Lite Preceptor Series sales sheets, 8/1996, pp. 42-45.

Four (4) photographs of Lithonia Lighting Signature Diecast Aluminium Exit Sign.

Lithonia Lighting Signature sales sheets, 1996, pp. 186-187.

Two (2) photographs of Prescolite Compass Diecast Aluminium Exit Sign.

Prescolite Compass sales sheets, 12/1997, pp. 326-327. --

UNITED STATES PATENT AND TRADEMARK OFFICE

CERTIFICATE OF CORRECTION

PATENT NO. : 6,050,013

DATED : April 18, 2000

INVENTOR(S) : Thomas K. Heaton and David Evarts

It is certified that error appears in the above-identified patent and that said Letters Patent is hereby corrected as shown below:

column 2, line 59, "of" should be --or--.

column 2, line 63, "on" should be --or--.

Signed and Sealed this

Tenth Day of October, 2000

*Attest:*

*Attesting Officer*

Q. TODD DICKINSON

*Director of Patents and Trademarks*